United States Patent [19]

Wenzlaff

[11] 4,254,405

[45] Mar. 3, 1981

[54] SELF-CONTAINED EMERGENCY ELECTRIC SIGNAL LIGHT AND AUDIBLIZER

[76] Inventor: Karl H. Wenzlaff, 9800 Baseline Rd., Space 107, Alta Loma, Calif. 91701

[21] Appl. No.: 65,284

[22] Filed: Aug. 9, 1979

[51] Int. Cl.[3] ..... G08B 5/00; G08B 23/00

[52] U.S. Cl. ..... 340/321; 340/87; 340/366 E; 362/362

[58] Field of Search ..... 340/321, 326, 331, 332, 340/366 E, 371, 87; 362/362

[56] References Cited

U.S. PATENT DOCUMENTS

| | | | |
|---|---|---|---|
| 2,261,222 | 11/1941 | Buell | 340/87 |
| 3,411,036 | 11/1968 | Casey | 340/331 |
| 3,624,635 | 11/1971 | Less | 340/371 |
| 4,047,150 | 9/1977 | Kelly | 340/331 |
| 4,156,894 | 5/1979 | Berry | 362/457 |

*Primary Examiner*—Donald J. Yusko
*Attorney, Agent, or Firm*—Mahoney & Schick

[57] ABSTRACT

A cup-shaped lower base adapted to have an upstanding viewing lens mounted thereon has a strip-like internal assembly bracket therein. The bracket has a vertically extending lower mounting end portion secured adjacent a base sidewall upwardly connected to a vertically and inwardly angled intermediate portion terminating upwardly in an inwardly projecting socket end portion generally centralized relative to the lens. A socket is attached projecting upwardly from the bracket socket end portion, a first electrical component such as a flasher is attached to the bracket intermediate portion and the bracket mounting end portion has a generally horizontally extending mounting tab on which is mounted a second electrical component such as an audiblizer, all of the socket and electrical components being operably electrically connected for proper actuation. In assembly, the socket and electrical components may be preassembled on the bracket exterially of the base and then assembled as a bracket unit in the base.

13 Claims, 5 Drawing Figures

SELF-CONTAINED EMERGENCY ELECTRIC SIGNAL LIGHT AND AUDIBLIZER

BACKGROUND OF THE INVENTION

This invention relates to a self-contained emergency electric signal light and more particularly, to such a signal light having all of the necessary electrical components including the electric light socket mounted on a single internal assembly bracket particularly adapted for ease and efficiency of assembling. The emergency electric signal light of the present invention is, therefore, specifically constructed for manufacture in an advantageously economical manner for ultimate consumer purchase at a minimum of cost even though of equally dependable operation in comparison with prior constructions of far greater cost.

Emergency electric signal lights of various forms have long since been heretofore provided, one of the principal prior uses being on various emergency vehicles. Furthermore, any emergency electric signal light of this general character in order to be operationally effective must include means for emitting light therefrom on a flashing or interrupted basis in order to be readily discernible to human eyesight. At the same time, certain of these emergency electric signal lights will include some form of audiblizer discernible to the human ear such as a horn or similar sound emitting device, again preferably on a steadily interrupted basis.

Although these emergency vehicles have made use of the emergency signal lights for a long period of years, one area of very advantageous and equally lifesaving possible area of use that has been sadly neglected has been at residences such as homes, mobile homes and house trailers. For instance, assume that a human health emergency occurs at a residence located in a relatively closely populated area and it is of sufficiently serious nature that an emergency vehicle such as a paramedic unit must be summoned. The most common means of summoning the same would be, of course, by telephone giving the required residence address. The major question then presented and very possibly of vital lifesaving nature is just exactly how the residence can be quickly located by the emergency vehicle.

It is usually relatively simple to locate the general neighborhood area of the residence within which the emergency has occurred and particularly by trained personnel. However, even once in the general neighborhood, the particular individual residence may not be easily located. The location of the particular individual residence must of course be accomplished by means of house numbers and it is well known that locating residence house numbers can frequently be quite time consuming. Even a few minutes and sometimes, even a few seconds, can determine the difference between life and death.

Now, if in just such an emergency situation, the particular residence where the emergency has occurred had a flashing signal light mounted thereon preferably also including some form of audiblizer such as a horn, and readily apparent to vehicles passing by the residence, the personnel of the emergency vehicle could virtually drive directly to that residence without any of the delays caused by attempting to locate the same. The result would be, therefore, vital emergency care in a minimum of time. With such important and highly desirable results, it is therefore queried why emergency electric signal lights for residences have not heretofore been extensively used and the best answer, it is believed, is two-fold, one that emergency electric signal lights particularly adapted for such residential use have not been provided and that such lights have not been so provided on an economical cost basis.

OBJECTS AND SUMMARY OF THE INVENTION

It is, therefore, an object of this invention to provide an emergency electric signal light which, although having many varied possible beneficial uses, is particularly adapted for being mounted on residential structures, such as homes, mobile homes, house trailers and the like, in order to serve as a residential locating device for emergency personnel and other persons providing emergency aid in the event the residence of a particular residential structure requires such emergency aid. The emergency signal light can be easily formed for convenient mounting at virtually any appropriate location on the particular residential structure, either through proper supporting mounting arms or other supporting means, the important criteria being that the emergency signal light is readily visible to passing emergency vehicles, thereby providing an immediate structure location. Also, particularly in its best embodiment form, the emergency signal light may include not only a readily visible flashing light, but also an interrupted sound-emitting signal, all cooperating for quick emergency detection.

It is a further object of this invention to provide an emergency electric signal light of the foregoing general type and character, and which, particularly in its best embodiment form, includes all of the foregoing advantageous features, yet it is of quite simplified form and may be manufactured and provided at a minimum of expense, far less than has heretofore been possible for similar devices. For instance, again in its best embodiment form, the emergency signal light may be formed with a simple overall housing comprised of a lower cup-shaped base and an upstanding, transparent viewing lens with preferably a single internal bracket supported in the housing and, in turn, supporting all of the necessary electrical components. The basic electrical component is, of course, the light socket and bulb, and other electrical components may be a flasher for the light resulting in a flashing light signal, as well as possibly some form of audiblizer, such as a horn, also preferably connected through the flasher to emit an interrupted sound signal in combination with the flashing light signal.

It is still a further object of this invention to provide an emergency electric signal light which, in its preferred embodiment form, has an extremely economical method of assembly which contributes greatly to the overall economics of the construction. In this preferred embodiment form, with all of the electrical components within the simple housing all mounted on the single mounting bracket, all such components, whether merely a light socket and bulb, a flasher, an audiblizer, or a combination of the three, all such components may be assembled on the single mounting bracket through unique attachment means while the mounting bracket remains exterior of and separate from the housing. The final assembly step is the mere mounting of the bracket including its attached components within the housing resulting in a completed operational emergency signal light ready for structure mounting and use.

Other objects and advantages of the invention will be apparent from the following specification and the accompanying drawings which are for the purpose of illustration only.

DESCRIPTION OF THE BEST EMBODIMENTS CONTEMPLATED

Figure 1:
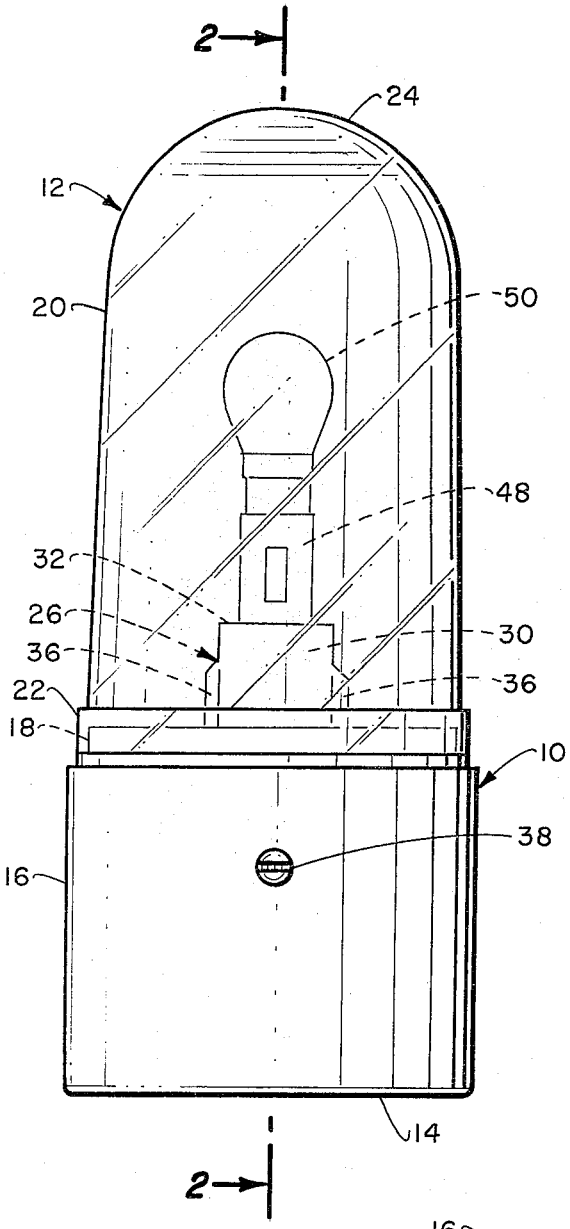
FIG. 1 is a side elevational view of a preferred embodiment of the self-contained emergency electric signal light and audiblizer of the present invention.

Referring to the two drawings, the preferred embodiment of the emergency signal light of the present invention includes a somewhat conventionally appearing housing formed by a lower base generally indicated at 10 and an upper upstanding viewing lens generally indicated at 12. The base 10 is preferably molded from plastic and is generally cup-shaped in configuration having a generally horizontal, circular bottom wall 14 and a generally vertical, hollow cylindrical sidewall 16 terminating upwardly in a lens mounting flange 18. The upstanding viewing lens 12 is also preferably molded from plastic, transparent or color transluscent, and is reverse cup-shaped in configuration having a hollow somewhat cylindrical, but slightly tapered sidewall 20 terminating downwardly in a base mounting flange 22 and upwardly in an arcuately domed top wall 24. The base mounting flange 22 of the viewing lens 12 is configured to telescope downwardly over the lens mounting flange 18 of the base 10 in assembly for selectively removable securement in any usual manner.

Figure 5:
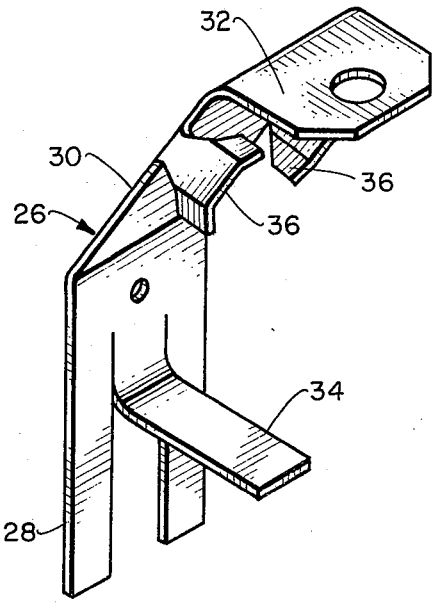
FIG. 5 is an enlarged perspective view of an electrical component mounting bracket prior to the assembly of the electrical components thereon and the subsequent assembly thereof in the emergency signal light of FIGS. 1 through 4.

A preferably metal, generally strip-like, electrical component mounting bracket is generally indicated at 26, shown separately from the emergency signal light assembly in FIG. 5, and is integrally formed with a generally vertical lower mounting portion 28, an inwardly and upwardly angled intermediate component portion 30 and a generally horizontal upper socket portion 32. From its lower extremity, the bracket lower mounting portion 28 is formed bifurcated the major portion of its height by a generally horizontal, inwardly projecting component mounting tab 34 which underlies the bracket intermediate component portion 30 merely to the upper socket portion 32. The intermediate component portion 30 is formed with opposite edge component resilient gripping tabs 36 which project from the intermediate component portion 30 angularly downwardly so as to be spaced upwardly from the lower mounting portion 28 and partially underlie the upper socket portion 32.

Figure 2:
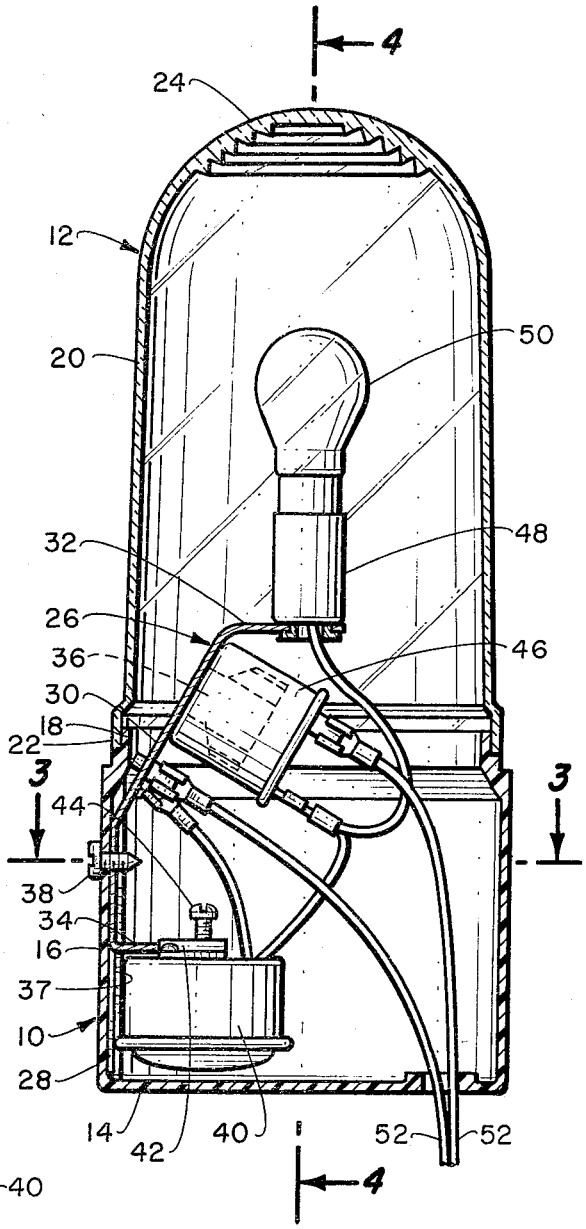
FIG. 2 is a vertical sectional view looking in the direction of the arrows 2—2 in FIG. 1.
Figure 3:
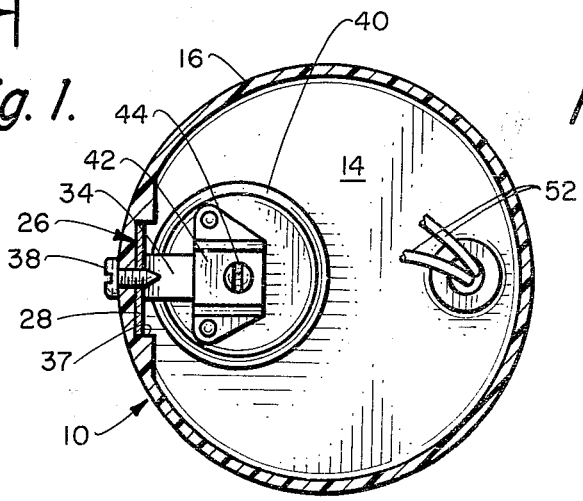
FIG. 3 is a horizontal sectional view looking in the direction of the arrows 3—3 in FIG. 2.

The electrical component mounting bracket 26 is positioned in the emergency signal light base 10 with the bracket lower mounting portion 28 received in a base sidewall positioning recess 37 (FIG. 3) and generally abutting the inner side of the base sidewall 16. The bracket lower mounting portion 28 terminates downwardly at the base bottom wall 14 and is secured to the base sidewall by a fastening screw 38 as best seen in FIGS. 2 and 3. This results in the component mounting tab 34 of the bracket lower mounting portion 28 being spaced above the base bottom wall 14, the bracket intermediate component portion 30 projecting angularly inwardly away from the base side wall 16 and the bracket upper socket portion 32 projecting generally horizontally into the central portion of the emergency signal light viewing lens 12.

Figure 4:
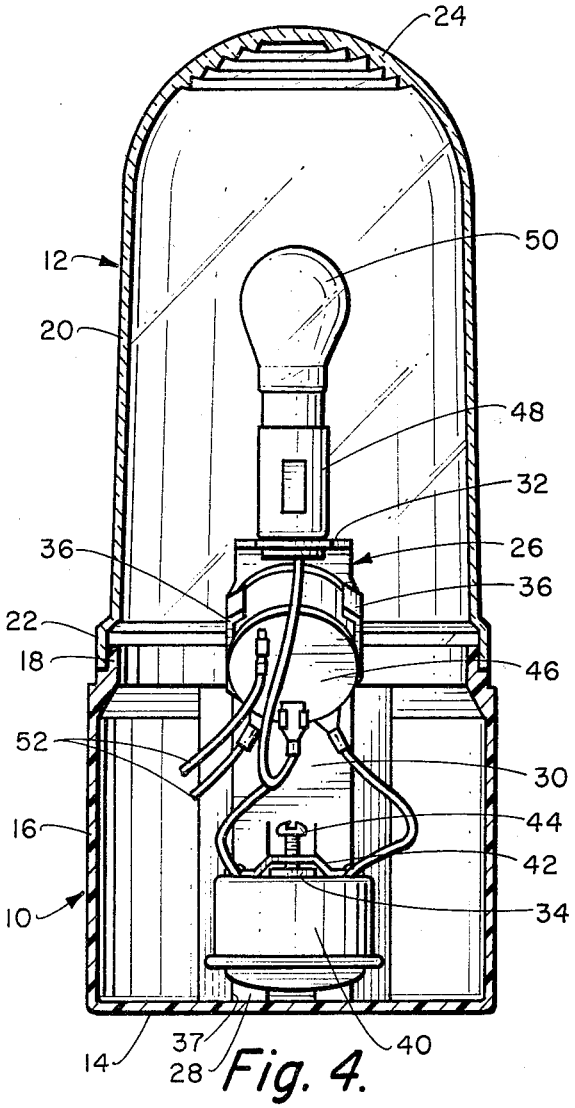
FIG. 4 is a vertical sectional view looking in the direction of the arrows 4—4 in FIG. 2.

An audiblizer preferably in the form of a usual electrically actuated horn 40 is preferably removably secured underlying the component mounting tab 34 of the bracket lower mounting portion 28 just above the base bottom wall 14, being removably secured to the component mounting tab 34 by tab slideable reception beneath a horn fastening strap 42 having a pressure screw 44 end abutting the component mounting tab 34. A conventional electric flasher 46 of the well-known bi-metal type which automatically steadily alternately interrupts and completes or "makes and breaks" an electrical circuit therethrough is positioned removably peripherally gripped by the component resilient gripping tabs 36 of the bracket intermediate component portion 30 as shown, for instance, in FIGS. 2 and 4. Finally, a usual electric bulb socket 48 with a usual electric bulb 50 positioned therein is secured to the bracket upper socket portion 32 projecting vertically upwardly from the bracket upper socket portion and generally centrally of the emergency signal light viewing lens 12.

The electrical circuit for the horn 40, the electric flasher 46 and the electric bulb socket 48 is provided by the electric power lines generally indicated at 52 which are preferably electrically connected such that the electrical power is first directed to the electric flasher 46 and then through the horn 40 and the electric bulb socket 48. Thus, with the electrical power to the emergency signal light through the electric power lines 52 "on," the electrical power to the horn 40 and the electric bulb socket 48 is controlled steadily "on" and "off" by the electric flasher 46 so that the horn 40 sounds steadily on that interrupted basis and the electric bulb 50 is "flashed" on that alternate basis. The electrical power is preferably relatively low amperage and 12 volts reduced from conventional residential electric power of 110 volts by a usual transformer (not shown).

In overall assembled form as shown in FIGS. 1 through 4 of the drawings, it is evident that the emergency signal light of the present invention is quite unique in construction. In its preferred embodiment form as shown, except for the cup-shaped base 10 and the upstanding viewing lens 12, the entire emergency signal light construction is made up of the strip-like electrical component mounting bracket 26 with its attached electrical components, that is, the horn 40, the electric flasher 46 and the electric bulb socket 48 with its electric bulb 50, all receiving their required electrical power through the electric power lines 52. Furthermore, this unique overall emergency signal light construction adapts itself for a novel method of production assembly during manufacturing.

In manufacturing, with the electrical component mounting bracket 26 separate from the base 10 and viewing lens 12, the electric bulb socket 48 is secured in place on the bracket upper socket portion 32, the electric flasher 46 selectively removably resiliently engaged with the component resilient gripping tabs 36 of the intermediate component portion 30, and the horn 40 selectively removably attached to the component mounting tab 34 of the lower mounting portion 28, all properly electrically connected to the electric power lines 52. This bracket and electrical component preassembly, is then inserted downwardly into the base 10 while the base is separate from the viewing lens 12 and the bracket and electrical component preassembly is secured in the base by the fastening screw 38. Finally, the electric bulb 50 is properly positioned in the electric bulb socket 48 and the viewing lens 12 is positioned over the base 10 to complete the entire assembly in a very simple and efficient manner with a minimum of production time.

In use of the emergency signal light of the present invention for one of its more ideal and intended uses as hereinbefore discussed, it may be mounted on the exterior of virtually any residence structure, such as a home, a mobile home, a house trailer and the like, in a position preferably exposed to and readily discernible from vehicles passing by the particular residence. The emergency signal light may be mounted on the residence structure either through the base end thereof alone or through one of various mounting brackets and arms. Furthermore, the electric power lines 52 of the emergency signal light are preferably directed into the residential structure where they may be connected through the previously mentioned transformer and some form of usual control box (not shown) and ultimately into the 110 volt residential structure electrical circuit.

Thus, although the emergency signal light will normally be retained in the "off" condition, if an emergency should occur involving one of the occupants of the residential structure and emergency assistance is required, the emergency signal light would be activated to "on" and the emergency assistance immediately summoned by a telephone. The emergency signal light would immediately start displaying its flashing light emergency signal and the audiblizer thereof would immediately begin sounding an emergency sound signal so that when the summoned emergency aid such as a paramedic unit approached the general vicinity of the residential structure, the particular emergency-incurring residential structure would very clearly be designated. In this manner, emergency aid can be obtained in a minimum amount of time which very well might mean the difference between life and death.

Although the construction and assembly methods of the emergency signal light of the present invention have been herein specifically illustrated in a preferred embodiment form, it should be understood that it is not intended to thereby limit the inventive principles to the specific form and method shown and described. Rather, the principles of the present invention should be broadly construed within the sole limits of the appended claims.

I claim:

1. In a signal light of the type having a lower base with an upstanding viewing lens enclosing an electric socket and bulb; the improvements comprising: an internal assembly bracket secured to said lower base projecting upwardly along a base sidewall and having an upper end portion positioned inwardly at generally horizontally centrally of said lens; said socket being secured to said bracket upper end portion projecting upwardly therefrom generally horizontally centrally of said lens; an electrical component mounted on said bracket spaced downwardly from said socket; electric circuit means operably connected to said socket and electrical component for supplying electricity thereto.

2. In a signal light as defined in claim 1 in which said bracket has an intermediate portion extending downwardly from said upper end portion and a lower mounting portion extending downwardly from said intermediate portion, said lower mounting portion being secured to said lower base, said intermediate portion angling upwardly and inwardly from said lower mounting portion and said upper end portion extending generally horizontally inwardly from said intermediate portion.

3. In a signal light as defined in claim 1 in which said bracket has an intermediate portion extending downwardly from said upper end portion and a lower mounting portion extending downwardly from said intermediate portion, said lower mounting portion being secured to said lower base, said intermediate portion angling upwardly and inwardly from said lower mounting portion and said upper end portion extending generally horizontally inwardly from said intermediate portion; and in which said electrical component is mounted on said bracket intermediate portion.

4. In a signal light as defined in claim 1 in which said bracket has an intermediate portion extending downwardly from said upper end portion and a lower mounting portion extending downwardly from said intermediate portion, said lower mounting portion being secured to said lower base, said intermediate portion angling upwardly and inwardly from said lower mounting portion and said upper end portion extending generally horizontally inwardly from said intermediate portion; in which said electrical component is a first electrical component mounted on said bracket intermediate portion and a second electrical component is mounted on said bracket lower mounting portion; and in which said electric circuit means is also operably connected to said second electrical component.

5. In a signal light as defined in claim 1 in which said bracket has an intermediate portion extending downwardly from said upper end portion and a lower mounting portion extending downwardly from said intermediate portion, said lower mounting portion being secured to said lower base, said intermediate portion angling upwardly and inwardly from said lower mounting portion and said upper end portion extending generally horizontally inwardly from said intermediate portion; in which said electrical component is a first electrical component mounted on said bracket intermediate portion by resilient means formed on said bracket intermediate portion; in which said bracket lower mounting portion is formed with an inwardly projecting mounting tab; in which a second electrical component is mounted on said inwardly projecting tab of said lower mounting portion; and in which said electric circuit means is also operably connected to said second electrical component.

6. In a signal light as defined in claim 1 in which said bracket terminates downwardly in a lower mounting portion secured to said lower base, said bracket lower mounting portion having an inwardly projecting tab extending inwardly from said base sidewall with said electrical component being mounted thereon.

7. In a signal light as defined in claim 1 in which said bracket is formed generally strip-like.

8. In a signal light as defined in claim 1 in which said bracket terminates downwardly in a lower mounting portion extending downwardly along said base sidewall and secured to said base sidewall.

9. In a signal light of the type having a lower base with an upstanding viewing lens enclosing an electric socket and bulb; the improvements comprising: an internal strip-like assembly bracket secured to said lower base projecting upwardly and having an upper end portion terminating generally horizontally centrally of said lens; said socket being secured to said bracket upper end portion projecting upwardly therefrom generally centrally of said lens; an electrical component mounted on said bracket spaced downwardly from said socket; electric circuit means operably connected to said socket and electrical component for supplying electricity thereto.

10. In a signal light as defined in claim 9 in which said bracket terminates downwardly in a lower mounting portion secured to said lower base and having a generally horizontally inwardly projecting mounting tab formed therein with said electrical component mounted on said mounting tab.

11. In a signal light as defined in claim 9 in which said electrical component is a first electrical component; in which said bracket terminates downwardly in a lower mounting portion having a generally horizontally inwardly projecting mounting tab; in which a second electrical component is secured to said mounting tab of said bracket lower mounting portion and said first electrical component is mounted on said bracket spaced above said second electrical component; and in which said electric circuit means is also operably connected to said second electrical component.

12. In a signal light as defined in claim 9 in which said bracket includes a lower mounting portion secured to said lower base and an intermediate portion angling upwardly and inwardly to said upper end portion; and in which said electrical component is mounted on said bracket intermediate portion.

13. In a signal light as defined in claim 9 in which said bracket includes a lower mounting portion secured to a sidewall of said lower base and an intermediate portion angling upwardly and inwardly to said upper end portion; in which said electrical component is a first electrical component mounted on said bracket intermediate portion; in which said bracket lower mounting portion has a generally horizontally inwardly projecting mounting tab formed therein and a second electrical component is secured to said mounting tab; and in which said electric circuit means is also operably connected to said second electrical component.

* * * * *